United States Patent [19]

Horan

[11] 3,988,781

[45] Nov. 2, 1976

[54] SIDE BELTED SURGICAL GOWN OR THE LIKE

[75] Inventor: Phyllis J. Horan, Tucson, Ariz.

[73] Assignee: Will Ross, Inc., Milwaukee, Wis.

[22] Filed: Dec. 24, 1975

[21] Appl. No.: 644,046

[52] U.S. Cl. ..... 2/338; 2/DIG. 7; 2/114

[51] Int. Cl.[2] ..... A41F 9/00; A41D 13/00

[58] Field of Search ..... 2/69, 69.5, 74, 83, 2/108, 114, 338, DIG. 7

[56] References Cited

UNITED STATES PATENTS

| | | | |
|---|---|---|---|
| 3,129,432 | 4/1964 | Belkih | 2/114 |
| 3,144,661 | 8/1964 | Buser | 2/114 |
| 3,594,818 | 7/1971 | Planner | 2/114 |
| 3,696,443 | 10/1972 | Taylor | 2/114 |
| 3,721,999 | 3/1973 | Goya et al. | 2/114 |
| 3,864,757 | 2/1975 | Hartigan | 2/114 |
| 3,935,596 | 2/1976 | Allen, Jr. et al. | 2/114 |

*Primary Examiner*—Werner H. Schroeder
*Assistant Examiner*—Moshe I. Cohen
*Attorney, Agent, or Firm*—Quarles & Brady

[57] ABSTRACT

A belt closure for a surgical gown includes a back belt member attached to the free edge of a back closure panel and a side belt member attached to the side of the gown, the gown being closed by tying the two belt members on the side rather than the front of the gown. The side belt member is housed in an open-ended storage sleeve and is folded so that its free end projects forwardly where it may be grasped easily by the wearer, with a loop of the belt extending rearwardly from the sleeve where it may be easily grasped by a non-sterile assistant.

2 Claims, 9 Drawing Figures

Fig. 3
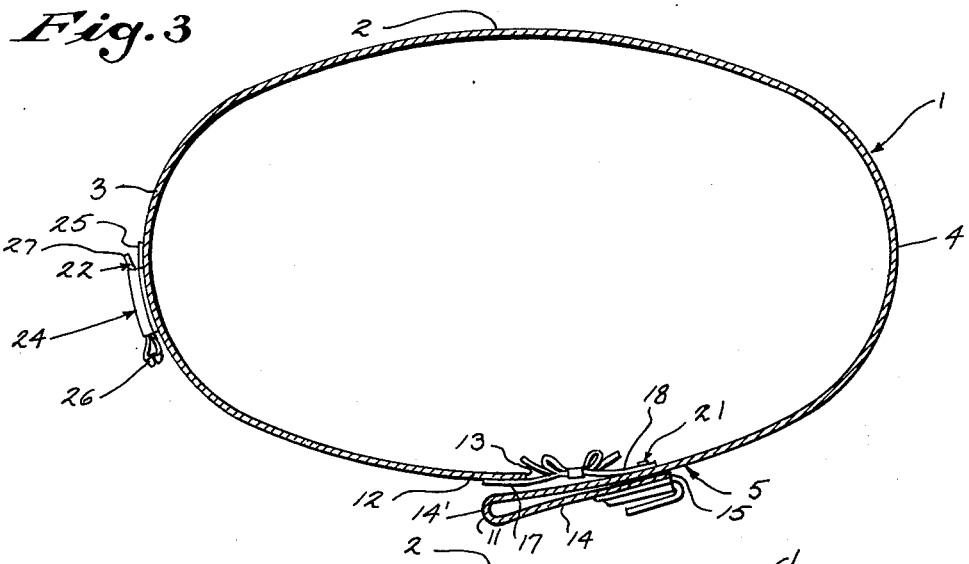
Fig. 4
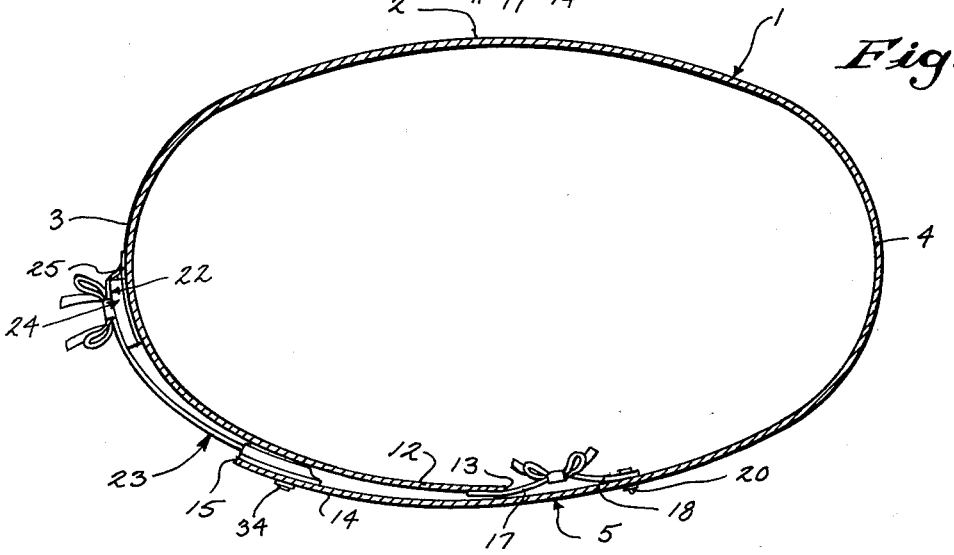
Fig. 5
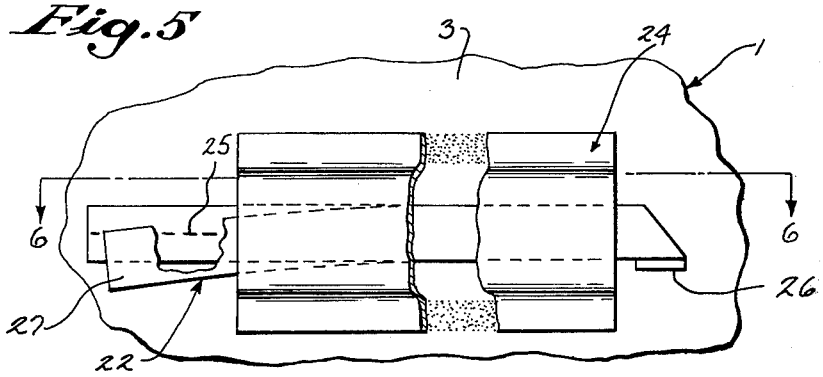
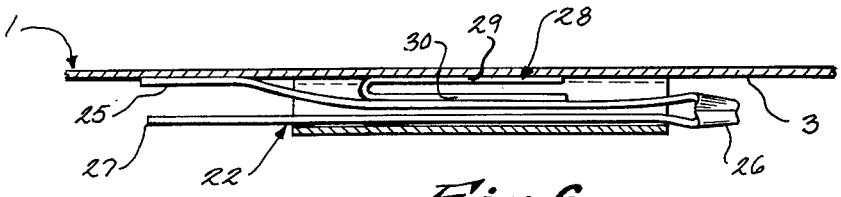
Fig. 6

SIDE BELTED SURGICAL GOWN OR THE LIKE

BACKGROUND OF THE INVENTION

This invention relates to, but is not necessarily limited to, surgical gowns worn by surgeons and other sterile personnel, particularly belted, back-opening, sterile-back gowns. Certain features of the preferred embodiment shown and described herein are described and claimed in the copending application of Robert T. Horan, Ser. No. 644,045, filed Dec. 24, 1975, for "Belt Closure for Sterile Back Surgical Gown or the Like."

There are numerous ways of closing surgical gowns, but belt closures are preferred in many cases because of their simplicity and strength, and because they make it relatively easy to adjust the size of the gown to the particular wearer. Previously devised belt closures have not, however, proven entirely satisfactory. In most cases, for example, the belt closure is made across the front of the gown and this causes some serious problems. For one thing, the material at the front is gathered under the belt and creates pockets which can trap surgical fluids and can easily result in "strike through" — gown materials are usually only moisture repellant as opposed to moisture proof, and fluids can go through the material if they are held against it long enough. Any passage of fluid through the materials destroys sterility, since bacteria from the wearer can then easily move outwardly through the material into the operative area. There is also a problem with front belted gowns when the wearer raises his arms during a procedure, since the gown material will be pulled above the belt and will blouse out when the wearer lowers his arms. The bloused material may interfere with the wearer's freedom of movement, and there is a temptation to pull it back below the belt by grasping the gown below the level of the table, which is a non-sterile area.

Known belt closures are also unsatisfactory in those situations where it is necessary or desirable to maintain sterility at the back as well as the front of the gown. This is necessary for those procedures where the wearer must turn his back toward the operative area; and it is desirable, for example, where two persons are working side by side, to avoid one having to pirouette about the other back to back when they change positions so that his gown front will not come near the gown back of the other.

Sterile back gowns generally have an inner back panel and an outer closure panel that is initially folded back on itself so that what will ultimately be the sterile outer surface is protected during donning. After the gown is donned, the closure panel is unfolded, so that it overlaps the inner panel and extends toward one side of the gown, and is then secured. This type of gown is generally very satisfactory, but it is difficult with a belt closure to provide means for handling and securing the closure panel quickly and properly without loss of sterility.

The noted and other problems involved in providing fully satisfactory belt closures can be complicated in the case of the disposable gowns now being used more and more frequently, largely because the material from which gowns are made does not have all the physical strength of the cloth from which reusable gowns are generally made.

SUMMARY OF THE INVENTION

This invention contemplates a belt closure for a surgical gown or the like where two belt members are tied at the side of the gown. This arrangement insures that the back closure panel is held tightly in place, but there is still no belt across the front of the gown and the wearer can reach the area where the belt members are to be tied which simplifies closure in sterile back situations. The invention further contemplates a side belt that is housed in a storage sleeve with its free end projecting forwardly where it may be easily grasped by the wearer. In the preferred embodiment, the side belt is folded so that there is also a loop that extends out of the back of the storage sleeve where it may be easily grasped by a non-sterile assistant for use in those situations where a sterile back is not necessary.

The invention provides a closure that is highly effective, versatile and sturdy, relatively simple and inexpensive, and particularly adapted for use with disposable gowns. Other objects and advantages will appear from the description to follow.

BRIEF DESCRIPTION OF THE DRAWINGS

FIG. 3 is an enlarged view in cross section through the plane 3—3 shown in FIG. 2, but in which an inner tie has been completed, FIG. 4 is an enlarged view in cross section through the plane 4—4 shown in FIG. 1, FIG. 5 is a further enlarged fragmentary view, partially broken away, showing the side belt of the gown in its storage sleeve, FIG. 6 is a view in cross section through the plane 6—6 shown in FIG. 5.

DESCRIPTION OF THE PREFERRED EMBODIMENTS

Figure 1:
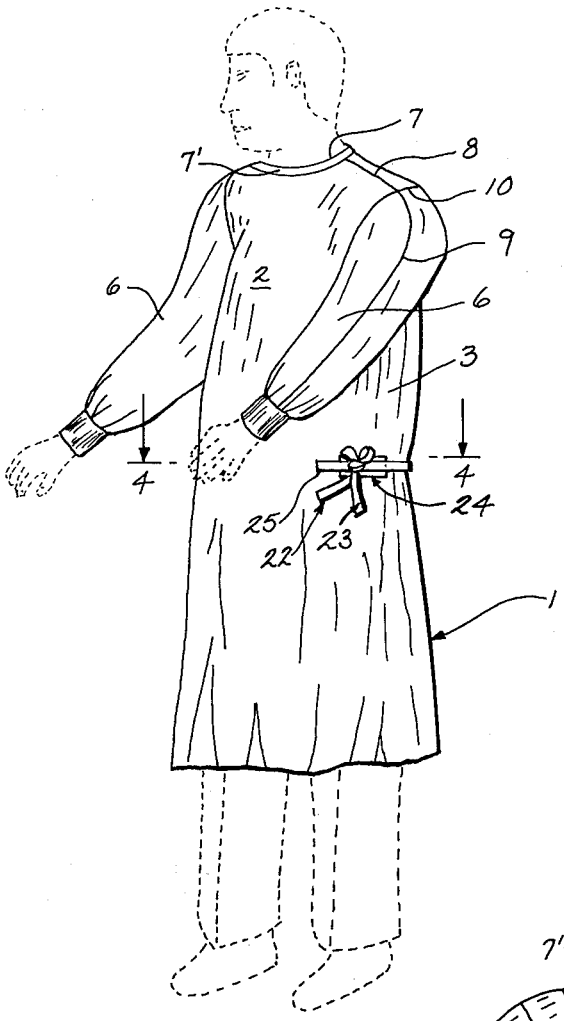
FIG. 1 is a schematic view in perspective showing a preferred embodiment of the invention, the gown being shown fully closed.

The gown shown in the drawings is designated generally by the reference numeral 1. It is of conventional overall configuration, including a front portion 2, a left side portion 3, a right side portion 4, a back portion 5, cuffed sleeves 6 and a taped neck opening 7. The gown 1 is preferably made of a suitable disposable paper material, although it may be made of cloth or other materials. The body of the gown 1 as shown is cut from a single piece of materials so that there are only two shoulder seams 8 running from the neck opening 7 to opposite sleeves 6. The sleeves 6 have single outside seams 9 and are stitched or otherwise secured to the gown body along the armhole line 10. While this construction is preferred, other known configurations are obviously possible, such as separate panels stitched together to form the body.

Figure 2:
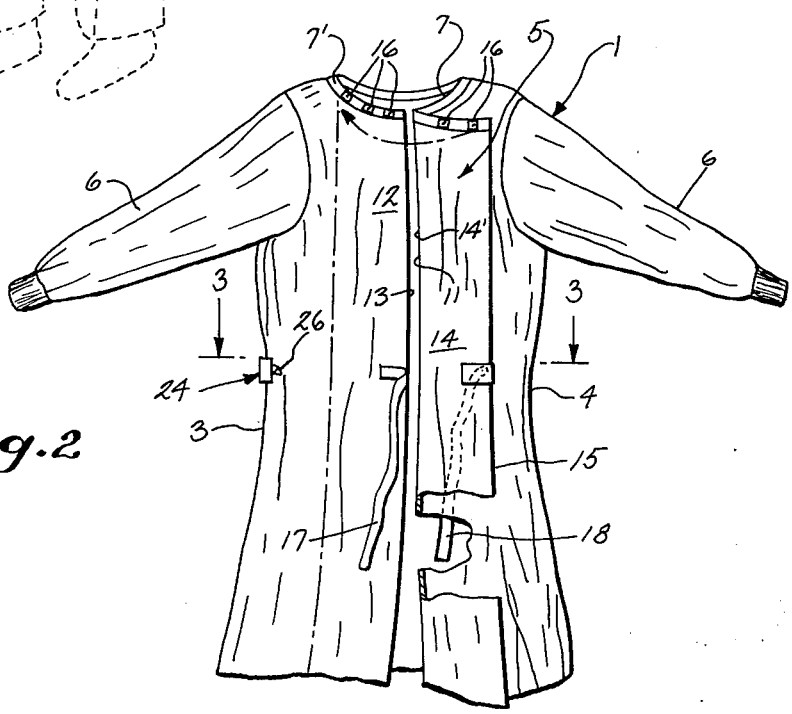
FIG. 2 is a back view, partially broken away, of the gown of FIG. 1, but showing the gown in an open condition.

Referring to FIG. 2, there is a vertical back opening line 11 running down approximately the middle of the back section 5 from top to bottom. The portion of the back 5 to the left of the line 11 as seen in FIG. 2 constitutes an inner back panel 12, and it has a free edge 13 parallel to and at the opening line 11. The right hand portion of the back panel as seen in FIG. 2 constitutes a closure panel 14 that is shown in an open position in which it is folded back on itself along a vertical fold line 14 that is also at and parallel to the line 11, the panel 14 having a free vertical edge 15. When the closure panel 14 is unfolded in the direction of the arrow as seen in FIG. 2, it moves to a closed position seen in FIG. 4 in which it extends across the opening line 11 and overlaps the panel 12, and its free edge 15 is toward the left side of the gown. This folded configuration is conventional for a sterile back gown; the facing surfaces of the folded panel 14 remain sterile during donning and, when unfolded, will provide a sterile surface across the back of the gown. As will be apparent, however, the invention is not restricted to sterile back gowns and may be used with other gown configurations.

Conventional snap closure members 16 are provided along the neck opening 7, the respective snap parts being on the outer surface of the panel 12 and what is the inner surface of the panel 14 when the gown is closed, and there are preferably a series of snaps 16 to allow the neck opening to be properly fitted to the user. As previously indicated, there is reinforcing tape around the opening 7, and the snaps 16 are attached through the tape for added strength. The neck closure can be made in conventional fashion by a non-sterile assistant; the neck area is generally accepted as being non-sterile for purposes of sterile back gown donning techniques.

Figure 8:
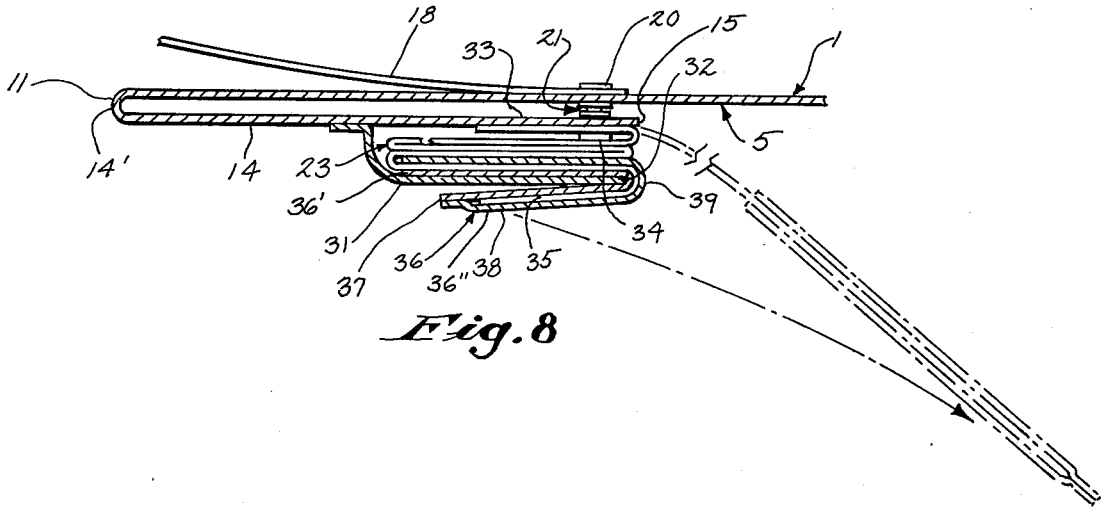
FIG. 8 is a view in cross section through the plane 8—8 shown in FIG. 7, with an alternative belt position indicated in broken lines.

The preferred embodiment includes an inner, waist-high tie closure in addition to the outer belt closure to be described. The tie closure comprises a first inner tie member 17 that has one of its ends glued or otherwise attached to the panel 12 at the edge 13 to be on the inner back panel side of the line 11. A second inner tie member 18 has one end attached to the inner surface of the gown at a point that is on the closure panel side of the line 11 near the free edge 15 when the panel 14 is folded. The members 17 and 18 can be tied together in conventional fashion to provide the inner closure as seen in FIGS. 3 and 4. This inner closure can be made by a non-sterile assistant before the panel 14 is unfolded, and this does not affect sterility since the sterile surface of the panel 14 will ultimately be over the inner closure. As can be seen in FIG. 8, the fixed end of the inner tie member 18 is attached to the material of the gown 1 by being glued along a portion 19 of its length and by being clamped — with the gown material — between the two sections of the male part 20 of a snap 21 that is used to hold the panel 14 in open position as will be described. This attachment of the tie 18 with the snap 20 is extremely advantageous in that the gown material, tie member 18 and snap part 20 mutually reinforce one another, and this is particularly important when the gown is made of disposable materials which are more easily tearable than conventional cloth.

After the neck and inner tie closures have been made, final closure of the gown 1 is made by means of a side belt member 22 and a back belt member 23, both of which are at approximately waist level and connected to parts of the gown as will be described. It is very important to note that the belt members 22 and 23 are tied or connected at a point on the side of the gown — the left side in the preferred embodiment, although the construction could be reversed — with no substantial portion of the belting extending across the front portion 2. As a result, there is no folding or bunching of material in the operative area and the problems hereinbefore noted are eliminated. The side and back belt constructions are seen most clearly in FIGS. 5–8, and it should be noted that sizes and spacings therein have been exaggerated for the sake of clarity.

The side belt 22 is, before closure, substantially encased and withdrawably stored in a horizontally oriented storage sleeve 24 on the side of the gown 1 at waist level, the sleeve 24 being open at both its forward and rear ends. The sleeve 24 is seen most clearly in FIGS. 5 and 6, and may be created very simply by gluing, stitching, or otherwise adhering the upper and lower horizontal edges of a rectangular piece of material, preferably the same as the gown material, to the side portion 3. The belt 22 and the belt 23 are also preferably made of the same material as the gown, and may be longitudinally folded and glued or stitched to give increased strength if desired.

One end of the belt 22 is glued or otherwise attached to the gown 1 at an area 25 immediately forward of the sleeve 24. As can be seen in FIG. 6, the belt 22 has a portion 22′ that extends horizontally rearwardly through and beyond the open rear end of the sleeve 24 where it is doubled back on itself to define a loop 26 that projects through the open rear end of the sleeve 24. The ribbon-like material of the belt 22 is preferably also twist folded at the loop 26 as shown to make the loop 26 more visible and easier to grasp. From the loop 26, the belt 22 returns forwardly through the sleeve 24 to present a free end 27 that projects through the open forward end of the sleeve 24. A reinforcing strip 28, preferably of the same material as the belt 22, has one end 29 attached to the gown 1 in the area covered by the sleeve 24, from which it extends forwardly to approximately the front edge of the sleeve 24 and is then doubled back upon itself to present a rearwardly extending end 30 that is attached to the rearwardly extending portion 22′ of the belt 22. For longer belts, additional folds within the sleeve 24 may be desirable.

Figure 7:
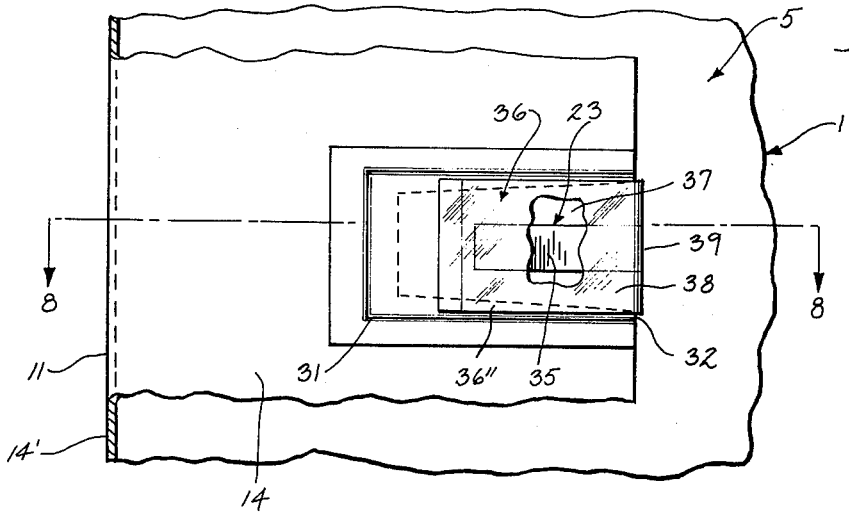
FIG. 7 is a further enlarged fragmentary view, partially broken away, showing the back belt member in its storage pocket.

As can be seen most clearly in FIGS. 7 and 8, the back belt 23 is withdrawably stored, before closure, in a pocket 31 that is formed by gluing or otherwise attaching the upper, lower and left edges, as seen in FIG. 7, of a rectangular piece of material, like that of the gown 1, to what is after full closure the inner surface of the panel 14, the pocket 31 having an open end 32 that is parallel to and approximately at the edge 15. The belt 23 is similar to the belt 22, and its fixed end is attached to the panel 14 in the area covered by the pocket 31 and near the open end 32. The attachment is made by means of a short glued section 33 and by clamping the belt and gown material between the two sections of the female part 34 of the snap 21, this attachment of the belt 18 with the part 34 providing the same mutual reinforcement provided for the tie 18. The belt 23 is folded upon itself as many times as may be necessary so that the bulk of its length is retained within the pocket 31 and only a relatively short free end portion 35 extends outwardly. The free end 35 is encased in an open-ended protective envelope 36 that is generally rectangular and is closed on three sides. The envelope 36 preferably includes a relatively stiff, foldable backing sheet 37 of paper, foil or other suitable material, and a transparent cover sheet 38 of a suitable plastic film that is heat sealed or otherwise attached to the backing sheet 37 along three sides to define the envelope 36. As can be seen in FIG. 8, the open end of the envelope 36 defines an anchoring portion 36' that extends substantially horizontally into the pocket 31. The envelope 36 is deadfolded along a vertical line 39 at and parallel to the open end 32 and its outer portion 36'', that encases the free end 35, lies on top of the pocket 31, or on top of that portion of the panel 14 that is initially exposed but ultimately faces inwardly. It is important that the outer portion 36'' of the envelope 36 remain relatively flat against the outer surface of the pocket 31, as opposed to relaxing and unfolding in a counterclockwise direction as seen in FIG. 8 to a point where it is over or nearer the adjacent sterile portion of the panel 5, since if such unfolding occurs the assistant's hand may touch or come too close to the sterile portion when the envelope is grasped. The deadfold prevents this, the term "deadfold" being intended to cover any suitable permanent or stable fold in which there is no significant tendency to unfold. Achieving the desired deadfold may require higher pressure and/or heat during the folding operation depending on the materials used, but the necessary techniques will be apparent to those skilled in the art.

The envelope 36 is arranged so that its outer or exposed surface, when the panel 14 is in the position of FIG. 2, is the transparent sheet 38, allowing the wearer to see the free belt end 35. Having the open end of the envelope 36 extend into the pocket 31 also helps to insure that the outer portion 36'', and the free end 35, are held in the positions shown in FIGS. 7 and 8, which is very important for sterile closure in that it makes it unnecessary for the assistant to put his or her hand near the sterile portion of the panel 5.

When the gown 1 is first donned, it will appear from the back as seen in FIG. 2. That is, the panel 14 will be held in its folded, open position to the right by the snap 21, the belt 22 will be in the sleeve 24, and the belt 23 will be in the pocket 31 with its free end in the envelope 36 but visible as described above. The entire gown 1 will have been pre-sterilized, and to this point will have remained completely sterile, assuming it is donned with generally accepted sterile gown donning technique. A non-sterile assistant can then make the neck closure and inside ties as described above.

After the neck and inside closures have been made, the assistant can grasp the exposed outer end 36'' of the envelope 36, and with it the free end 35 of the belt 23; as previously noted, having the end 36' of the envelope 36 in the pocket 31 with the deadfold 39 is very important in this regard since it insures that the envelope 36 will be in the position shown in FIGS. 7 and 8, which means that the assistant's hand need come near only that portion of the panel 14 that will ultimately face inwardly. The transparent sheet 38 is also important since the assistant will be able to see that he or she is actually grasping the free end 35. The assistant will then pull the belt 23 laterally outwardly — to the right as seen in FIGS. 7 and 8 — until it is fully removed from the pocket 31. The assistant will then pull the belt 23 radially outwardly — downwardly as seen in FIG. 8 — which will cause the parts of the snap 21 to separate and thus free the closure panel 14. The assistant will then pass the belt 23 around to the left as seen in FIG. 2 to the point where it can be reached by the wearer. The wearer will grasp the belt 23 immediately behind the envelope 36, and the assistant can then simply pull the envelope 36 of the free end 35, leaving the wearer with a completely sterile back belt section.

Before or after he receives the belt 23, the wearer can grasp the free end 27 of the belt 22 and pull it forwardly to remove it from the sleeve 24. He can then pull it rearwardly and tie it to the belt 23; again, it is important to note that the tie is made at the side of the wearer which is an easily reachable area, and the left side is preferred for right handed wearers.

The reinforcing strip 28 is important in connection with removal and use of the belt 22. When the wearer first removes the belt 22, he will be pulling it forwardly and if the reinforcement strip 28 were not present there would be a tendency to peel the belt 22 off the gown 1 at the attachment area 25. The strip 28, however, provides reinforcement to prevent such peeling. Thereafter, the wearer will be moving the belt 22 toward the rear, which would tend to peel the connection of the strip 28 to the gown 1, but during this phase of the operation the attachment area 25 is effective to prevent peeling. The construction shown is preferred, but an equivalent construction might be made by reversing the forward-rearward orientation of the belt 22 and strip 28 or otherwise.

The loop 26 is not used when closure is made in the sterile fashion described above — the material of the loop is simply pulled through the sleeve 24 by the wearer. The loop 26 is, however, very important in that it allows for non-sterile closure by a non-sterile assistant in those cases where a sterile back is not necessary. That is, the assistant can simply grasp the belt 22 at the loop 26 and pull the material rearwardly through and out of the sleeve 24 and tie it to the belt 18, the folded configuration of the loop 26 making it easier to grasp for this purpose. If there were no loop extending out the rear of the sleeve 24, it would be necessary for the assistant to reach around the side of the wearer and grasp the free end 27, which would raise the possibility of contamination of the sterile side and front areas of the gown 1.

Figure 9:
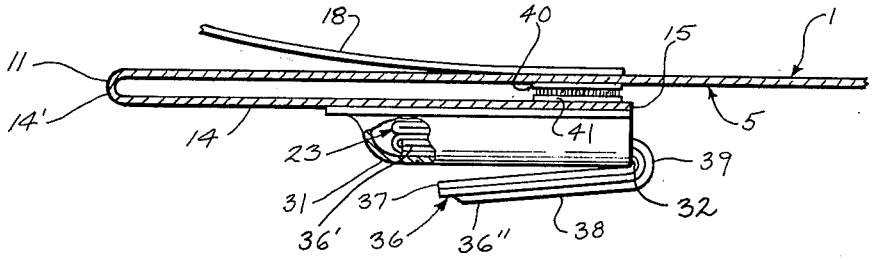
FIG. 9 is a view similar to FIG. 8 but showing an alternative pressure-sensitive closure construction.

FIG. 9 shows a variation of the preferred embodiment which is identical in all respects except that the snap 21 has been replaced by mating sections of Velcro hook-type fastener material. There is an inner Velcro path 40 which is glued or stitched to the material of the gown 1 with the fixed end of the inner tie 18 to provide mutual reinforcement. An outer Velcro path 41 is glued or stitched to the panel 14 with the fixed end of the belt 23, also providing mutual reinforcement.

The preferred embodiments of the invention shown and described are highly effective, but it will be obvious that various modifications might be made without departure from the spirit of the invention. The invention may, for example, be useful for garments other than surgical gowns. As illustrated by FIG. 9, the snap closures might be replaced by other forms of pressure sensitive closure means. Different methods of attachment, materials and specific configurations might be substituted in the specific belts shown, particularly the back belt. In view of the possible modifications, the invention is not intended to be limited by the showing or description herein, or in any other manner, except insofar as may specifically be required.

I claim:

1. A belt closure for a surgical gown or the like of the type wherein there is a vertical back opening line, an inside back panel with a free edge parallel to the opening line, and a closure panel adapted to be placed in a closed position where it extends across the opening line and overlaps the inside panel and presents a vertical free edge toward one side of the gown, said closure comprising: a back belt having a fixed end attached to the closure panel near its free edge; a side belt having a fixed end connected to said one side forwardly of the free edge of the closure panel when it is in closed position, said belts having free ends that are tyable at said one side of the gown; and a horizontally oriented storage sleeve for the side belt that is attached to said one side of the gown and that is open at both ends, the side belt having its fixed end near the sleeve and being folded within the sleeve so that it has a manually graspable loop portion extending through and beyond one end of the sleeve and so that its free end extends through and beyond the other end of the sleeve to be manually graspable.

2. A closure according to claim 1, wherein: the free end of the side belt extends through and beyond the forward end of the storage sleeve and the loop portion extends through and beyond the rear end of the storage sleeve.

* * * * *

UNITED STATES PATENT OFFICE
CERTIFICATE OF CORRECTION

PATENT NO. : 3,988,781
DATED : November 2, 1976
INVENTOR(S) : Phyllis J. Horan

It is certified that error appears in the above-identified patent and that said Letters Patent are hereby corrected as shown below:

| | | |
|---|---|---|
| Column 1, | line 57, | "is" (first occurrence) should be deleted. |
| Column 1, | line 66, | after "which" -- such -- should appear. |
| Column 2, | line 61 | "materials" should be -- material -- |
| Column 3, | line 29, | after "tape" -- 7 -- should appear (with the indicated prime) |
| Column 3, | line 58, | after "snap" -- part -- should appear |
| Column 5, | line 29, | after "38," -- this -- should appear |
| Column 6, | line 2, | "of" should be -- off -- |
| Column 6, | line 46, | "path" should be -- patch -- |
| Column 6, | line 48, | "path" should be -- patch -- |

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*